US011535493B2

(12) United States Patent
Studer et al.

(10) Patent No.: US 11,535,493 B2
(45) Date of Patent: Dec. 27, 2022

(54) ELEVATOR SYSTEM

(71) Applicant: Inventio AG, Hergiswil (CH)

(72) Inventors: Christian Studer, Kriens (CH); Josef Husmann, Lucerne (CH)

(73) Assignee: INVENTIO AG, Hergiswil NW (CH)

( * ) Notice: Subject to any disclaimer, the term of this patent is extended or adjusted under 35 U.S.C. 154(b) by 344 days.

(21) Appl. No.: 16/634,902

(22) PCT Filed: Jul. 31, 2018

(86) PCT No.: PCT/EP2018/070656
§ 371 (c)(1),
(2) Date: Jan. 29, 2020

(87) PCT Pub. No.: WO2019/034405
PCT Pub. Date: Feb. 21, 2019

(65) Prior Publication Data

US 2020/0231410 A1 Jul. 23, 2020

(30) Foreign Application Priority Data

Aug. 17, 2017 (EP) ..... 17186585

(51) Int. Cl.
*B66B 9/00* (2006.01)
*B66B 11/00* (2006.01)

(52) U.S. Cl.
CPC ..... *B66B 9/003* (2013.01); *B66B 11/0095* (2013.01); *B66B 2201/30* (2013.01)

(58) Field of Classification Search
CPC .... B66B 9/00; B66B 7/06; B66B 7/02; B66B 11/0095; B66B 19/005; B66B 1/2466;
(Continued)

(56) References Cited

U.S. PATENT DOCUMENTS 7,469,774 B2 12/2008 Ach
9,248,994 B2 * 2/2016 Grundmann ..... B66B 9/003
(Continued)

FOREIGN PATENT DOCUMENTS

CN 1749143 A 3/2006
CN 101896416 A 11/2010
(Continued)

*Primary Examiner* — Marlon T Fletcher
(74) *Attorney, Agent, or Firm* — William J. Clemens; Shumaker, Loop & Kendrick, LLP

(57) ABSTRACT

An elevator system includes first and second elevator cars movable vertically in a first elevator shaft, a closed support belt routed around lower and upper deflection rollers, a drive machine driving the support belt, and an actuable coupling device arranged on each of the first and second elevator cars. The support belt has first and second coupling elements to and from which the coupling devices can be coupled and decoupled whereby a drive connection between the respective elevator car and the support belt can be established and released. A coupled elevator car is moved in the first elevator shaft by the support belt driven by the drive machine. The coupling elements are arranged such that they are not routed around the deflection rollers during movement of the first elevator car from a lower end position to an upper end position or vice versa.

15 Claims, 3 Drawing Sheets

(58) Field of Classification Search
CPC ..... B66B 2201/306; B66B 19/02; B66B 7/04; B66B 5/26; B66B 7/047; B66B 23/02; B66B 7/1269; B66B 15/08; B66B 23/14; B66B 23/145
See application file for complete search history.

(56) References Cited

U.S. PATENT DOCUMENTS

| | | | | |
|---|---|---|---|---|
| 9,758,347 | B2 | 9/2017 | Dudde et al. | |
| 2008/0142308 | A1* | 6/2008 | Kocher | B66B 9/00 187/249 |
| 2008/0142310 | A1* | 6/2008 | Kocher | B66B 11/0095 187/401 |

FOREIGN PATENT DOCUMENTS

| | | | | |
|---|---|---|---|---|
| CN | 107000991 | A | 8/2017 | |
| DE | 2542262 | A1 | 3/1977 | |
| EP | 1634842 | A2 | 3/2006 | |
| EP | 1647513 | A2 | 4/2006 | |
| EP | 1693331 | A1 | 8/2006 | |
| EP | 1935827 | A1 * | 6/2008 | B66B 11/0065 |
| EP | 2070860 | A1 * | 6/2009 | B66B 9/00 |
| EP | 2219985 | B1 | 2/2013 | |
| FR | 2958635 | A1 * | 10/2011 | B66B 7/022 |
| WO | 2010072656 | A1 | 7/2010 | |
| WO | WO-2011161104 | A1 * | 12/2011 | B66B 5/0031 |
| WO | WO-2015043758 | A1 * | 4/2015 | B66B 7/06 |
| WO | WO-2015043759 | A1 * | 4/2015 | B66B 7/06 |
| WO | WO-2015043765 | A1 * | 4/2015 | B66B 11/0095 |
| WO | WO-2019034381 | A * | 2/2019 | B66B 11/0095 |
| WO | WO-2019034405 | A1 * | 2/2019 | B66B 11/0095 |
| WO | WO-2020164965 | A1 * | 8/2020 | B66B 11/0095 |

* cited by examiner

ELEVATOR SYSTEM

FIELD

The invention relates to an elevator system having two elevator cars moved in an elevator shaft by a drive machine and a closed support means guided about a lower deflection roller and an upper deflection roller. Actuatable coupling devices provide a drive connection between the support means and the elevator cars.

BACKGROUND

EP 2219985 B1 describes an elevator system comprising two elevator cars which can be moved in an elevator shaft in the vertical direction, a closed support means which is guided about a lower deflection roller and an upper deflection roller, a drive machine in the form of an electric motor which is assigned to the support means, and an actuatable coupling device arranged on each elevator car. The support means has a plurality of coupling elements, which, for example, can be designed as holes or cams. A coupling device of an elevator car can be coupled to and decoupled from a coupling element; as a result, a drive connection can be established and detached between the relevant elevator car and the support means. An elevator car coupled to a support means can thus be moved in the first elevator shaft by means of the support means drivable by the relevant drive machine.

In said elevator shaft, the elevator cars are moved in only one direction, i.e. only upwards or only downwards. In order to be able to realize a continuing operation of the elevator cars, the elevator system has a further elevator shaft. By means of a transfer device, the elevator cars can be displaced horizontally between the two elevator shafts. During operation of the elevator system, an elevator car is coupled to a support means at a lower or an upper end position via its coupling device and a coupling element, and via the support means, it is moved upwards or downwards by the associated drive machine until it reaches the upper or lower end position. There, the elevator car is decoupled from the support means and is horizontally displaced to the other elevator shaft by a transfer device to the elevator shaft for the other movement direction.

SUMMARY

By contrast, the problem addressed by the invention is in particular to propose an elevator system which allows convenient operation, in particular without placing any particular demands on the design of the coupling elements of the support means.

The elevator system according to the invention has a first elevator car and a second elevator car which can be moved in a first elevator shaft in the vertical direction. It further comprises a closed support means which is guided about a lower deflection roller and an upper deflection roller, a drive machine which is assigned to the support means, an actuatable coupling device arranged on the first elevator car and an actuatable coupling device arranged on the second elevator car. The support means has a first and a second coupling element, to and from which a coupling device of an elevator car can be coupled and decoupled; as a result, a drive connection can be established and detached between the relevant elevator car and the support means. A coupled elevator car can thus be moved in the first elevator shaft by means of the support means drivable by the relevant drive machine. According to the invention, the two coupling elements of the support means are arranged such that in the event of a movement of the first elevator car, which is coupled to the support means via a coupling element, from a lower end position to an upper end position, or vice versa, no coupling element of the support means is guided about a deflection roller.

In case of the aforementioned movement of the elevator car between the two end positions, i.e. at a maximum movement in the elevator shaft, no coupling element is thus guided about or over one of the deflection rollers. As a result, only the flexible support means is guided over the deflection rollers, which is possible without loss of comfort, such as jerking or noise generation. In addition, with regard to the design of the coupling elements, whether they are guided about or over the deflection rollers at all, or whether they can be guided about or over the deflection rollers with the least possible loss of comfort, can be disregarded. The coupling elements can thus be optimally adapted to their task, i.e. to allow for the coupling of the coupling device to a support means. In addition, in the region of the deflection rollers, no installation space has to be provided in which the coupling elements can be guided about the deflection rollers. This allows for a simpler design of the elevator system.

The described arrangement of the coupling elements on a support means makes it possible to actuate the drive machine assigned to the support means such that, during the operation of the elevator system, no coupling element is ever guided about a deflection roller.

The elevator shaft is arranged in or on a building and runs mainly in the vertical direction, and therefore the elevator cars are moved mainly vertically when moved in the elevator shaft. Said first and second elevator cars do not have to be movable simultaneously in the first elevator shaft. It is in particular possible that at first, the first elevator car is moved in the elevator shaft and subsequently, the second elevator car is moved in particular in the same direction in the elevator shaft. For this purpose, the first elevator car is removed from the elevator shaft in particular before or during the movement of the second elevator car.

The support means is closed, i.e. designed in an annular manner, for example. It can thus also be called continuous. However, this does not necessarily mean that it is designed as a homogeneous ring or only as one piece. The support means is guided about a lower and an upper deflection roller, with at least one deflection roller serving as a drive roller or propulsion disk, by means of which the support means can be driven by the assigned drive machine. The deflection rollers in particular have an effective diameter of less than 100 mm. Such small effective diameters of a deflection roller serving as a propulsion disk allow for a gearless drive of the support means, which takes up little installation space. The deflection rollers are in particular arranged such that their respective rotational axes are perpendicular to an adjacent shaft wall of the elevator shaft. On the support means, in particular a tensioning device can be arranged, by means of which the required support means pretension is generated, and deviations in the initial length of the closed support means as well as operational plastic changes in length of the support means are compensated. The required tensioning forces can be generated, for example, using tension weights, gas springs, or metal springs.

The drive machine is designed in particular as an electric motor which is actuated by an elevator controller. The elevator controller controls the complete operation of the elevator system, i.e. it actuates all actuatable components of the elevator system and is connected to switches and sensors of the elevator system. The elevator controller can be designed as a single central elevator controller or can consist of several decentralized controllers which are responsible for subtasks.

The coupling devices arranged on the elevator cars are arranged in particular on a floor or a roof of the elevator cars and are actuated by the above-mentioned elevator controller. The coupling to a coupling element of the support means takes place in particular in an interlockingly connected manner, with a frictionally engaged coupling also being conceivable. The coupling element has in particular a mainly horizontally oriented recess, into which, for example, an extendable and retractable bolt of the coupling device can be inserted in an actuation direction. The coupling device and the coupling element can thus be used to produce an interlocking or frictionally engaged connection between the elevator car and the support means, and therefore the elevator car is also moved when the propulsion means is moved. As a result, a drive connection between the elevator car and the support means and therefore ultimately between the elevator car and the drive machine assigned to the support means can be produced and released again. The coupling devices are actuated such that, at least during the movement of an elevator car, only one elevator car is coupled to a (single) support means. Therefore, only one (single) elevator car at a time is moved in the shaft by a (single) support means.

In an embodiment of the invention, the two coupling elements of the support means are arranged such that in the event of a movement of the first elevator car, which is coupled to the support means via a coupling element, from a lower end position to an upper end position, or vice versa, no coupling element comes into contact with a deflection roller. In other words, the coupling element does not touch the deflection rollers. As a result, no deflection roller can be damaged by a coupling element, or vice versa.

This arrangement of the coupling elements on a support means makes it possible to actuate the drive machine assigned to the support means such that, during the operation of the elevator system, no coupling element ever comes into contact with a deflection roller. The support means can thus always be stopped in time such that the coupling elements never reach the deflection rollers or, for example, maintain a specific minimum distance from the deflection rollers.

In an embodiment of the invention, the two coupling elements of the support means are arranged such that, when the first elevator car, which is coupled to the support means via a coupling element, has reached the upper end position in the event of an upward movement, the other coupling element is positioned such that the coupling device, assigned to the second elevator car, of the second elevator car arranged in the lower end position can be coupled to the other coupling element. In the event of a downward movement of the first elevator car, the other coupling element, upon the first elevator car reaching the lower end position, is correspondingly positioned such that the coupling device of the second elevator car arranged in the upper end position can couple to the other coupling element. Therefore, whenever the first elevator car has reached one of the two end positions, the second elevator car at the other end position can couple to a coupling element and thus prepare the movement of the second elevator car. As a result, the decoupling of the first elevator car and the coupling of the second elevator car can take place, at least to some extent, simultaneously, thus allowing for an effective operation of the elevator system.

In an embodiment of the invention, the drive machine is controlled by an elevator controller. It is provided to reverse a movement direction of the support means for the next movement of an elevator car when an elevator car, depending on the movement direction, has reached the lower end position or the upper end position. It is thus advantageously possible to move both elevator cars of the elevator system in the same direction in the elevator shaft without a coupling element being guided about a deflection roller or coming into contact with a deflection roller during the operation of the elevator system. The elevator controller is thus provided to move the elevator cars in the elevator shaft only in one direction, i.e. only from the bottom to the top or only from the top to the bottom.

In an embodiment of the invention, the elevator system has at least one further support means comprising two coupling elements spaced apart from one another in the vertical direction and a further drive machine assigned to the further support means. The coupling elements are arranged as in the case of the support means already described. The support means are in particular arranged in parallel beside one another in the elevator shaft. The elevator controller is in particular provided to actuate the two drive machines of the support means independently of one another. Therefore, another elevator car can be displaced in the elevator shaft by means of a second support means simultaneously with the first elevator car and independently of the first elevator car. As a result, it is possible to operate the elevator system particularly effectively, and many passengers, in particular with different destination floors in the building, can be transported. In particular, the elevator system has more than two, in particular four, such support means. It is also conceivable for the elevator system to comprise more than four such support means.

If more than one support means is present, it may be necessary for the coupling devices to be able to couple to the coupling elements of the different support means. In such cases, the coupling devices are arranged so as to be movable horizontally, in particular transversely to their actuation direction. If an elevator car is supposed to be coupled to a support means, the coupling device is first moved transversely to its actuating direction such that it is correctly positioned with respect to the coupling element of the corresponding support means. Subsequently, the support means can be coupled in particular by extending the bolt of the coupling element. For this case, it is also possible that one correspondingly positioned coupling device is provided on the elevator car per support means.

Even if a plurality of support means is present, one coupling device in a fixed position, i.e. one non-displaceable coupling device, may be sufficient per elevator car. This requires an elevator car to be assigned to a coupling element, which shall be described in greater detail below.

In an embodiment of the invention, a coupling element of each support means is designed as a connecting element which interconnects two free ends of support means parts. Therefore, the coupling element can advantageously fulfill a dual function, namely allowing both the coupling of an elevator car and also a closed support means. The coupling element in particular fulfills the function of a so-called belt fastener or a cable connector. As a result, a closed support means can be produced in a very simple, cost-effective, and safe manner from an open, elongate support means part by connecting the two free ends to the coupling element. The support means thus consists of two support means parts, the free ends of which are connected by means of a primary coupling element and a secondary coupling element. In this case, each of the free ends of the first support means part is connected to a free end of the second support means part, such that the support means forms a closed ring. For example, the coupling element can comprise two interconnected support means end connections which, for example, can be designed according to EP 1634842 A2. The two support means end connections can be connected, for example, via an intermediate piece, by means of which they can be screwed or welded together, for example. The coupling element can also have a one-piece housing.

In particular, both coupling elements of each support means are designed as connecting elements. Therefore, a support means of the elevator system according to the invention consists of two open, elongate support means parts and two coupling elements designed as connecting elements, which each interconnect two free ends of different support means parts. The coupling elements are in particular designed to be identical. This allows as many identical parts to be used as possible, which both allows for a lower manufacturing costs and makes mounting easier, since all coupling elements can or must be mounted identically.

In an embodiment of the invention, the support means are designed as belts. Belts have excellent traction properties and are particularly well suited to interact with actuatable coupling devices. The belts can e.g. be designed as flat belts, V-ribbed belts, or toothed belts, and can be reinforced with tensile reinforcements in the form of wire cables, synthetic fiber cables, or synthetic fiber fabrics. As a result, an elevator car coupled to the support means can be moved over a great height without the occurrence of undue vertical vibrations.

However, it is also possible that the support means consists of one or more cables, in particular wire cables.

In an embodiment of the invention, the coupling elements are guided in the elevator shaft in the event of a movement. The guide used for this purpose is in particular designed such that it prevents the coupling elements from striking against a passing elevator car. This allows for particularly comfortable and safe operation of the elevator system. In the event of a movement of an elevator car in the elevator shaft, it cannot be completely ruled out that the support means and thus the coupling element not connected to an elevator car are caused to vibrate. Without a guide of the coupling element, there would in particular be the risk of the coupling element striking against the passing elevator car. Such a strike would lead to an audible blow and could also cause damage to the elevator car and/or the coupling element. This risk is prevented by the guide of the coupling elements.

In an embodiment of the invention, each elevator car has two coupling devices. These are provided to simultaneously couple to coupling elements of two different support means. The drive machines of the two support means are actuated in a synchronized manner, such that both support means are driven and moved in a synchronized manner. The two coupling devices of an elevator car are arranged in particular on opposite sides of the elevator car. They are provided in particular to be coupled at diagonally opposite positions to one coupling element of a support means in each case. This allows for force to be introduced into the elevator car in a particularly even or evenly distributed manner, which allows for very slight tilting of the elevator car during movement. As a result, comfortable movement of the elevator car is possible and the guides of the elevator car are only slightly stressed, which allows for a simple and more cost-effective design and also leads to very low wear. In addition, only about half the force must be applied via a coupling device when compared with only one coupling device per elevator car. This allows for the use of more cost-effective drive machines, which also require only a small installation space.

For this purpose, the two coupling devices are in particular not mechanically coupled, but instead are correspondingly actuated by the elevator controller. When coupled to the two support means, the coupling devices are in particular positioned such that a connecting line extends at the level of the center of gravity of the elevator car between the two coupling elements of the support means through said center of gravity. This allows for force to be introduced into the elevator car particularly evenly.

It is also possible that each elevator car has only a single coupling device. The elevator car can then only be coupled to one support means and moved in the elevator shaft by means of said support means.

In an embodiment of the invention, the first and the second elevator car can also be moved in a vertical direction in a second elevator shaft arranged in parallel with the first elevator shaft. The elevator system also comprises a first transfer device, by means of which elevator cars can be displaced from the first elevator shaft to the second elevator shaft, and a second transfer device, by means of which elevator cars can be displaced from the second elevator shaft to the first elevator shaft. In this case, a movement of the elevator cars in the second elevator shaft is realized analogously to the movement in the first elevator shaft. In the first elevator shaft, the elevator cars are in particular moved only from the bottom to the top, and in the second elevator shaft only from the top to the bottom. In this case, it is not relevant which elevator shaft is denoted as the first elevator shaft and which is denoted as the second elevator shaft.

In this context, an analogous realization of the movement of the elevator cars in the elevator shaft is supposed to refer to the fact that at least one support means comprising two correspondingly arranged coupling elements is also provided in the second elevator shaft and can be driven via an assigned drive machine. In addition, all the above-mentioned embodiments of the invention are also applicable to the second elevator shaft.

The provision of the second elevator shaft and the two transfer devices advantageously allows for continuous operation of the elevator system. The transfer devices are arranged in particular in the region of the end positions of the elevator cars. For example, if an elevator car reaches the upper end position in the event of an upward movement in the first elevator shaft, it is horizontally displaced to the upper end position of the second elevator shaft by means of the upper transfer device after all passengers have left the elevator car and it has decoupled itself from the support means. Subsequently, it can couple itself to a support means in the second elevator shaft and thus be moved in a downward direction in the second elevator shaft to the lower end position. From there, it is once again displaced horizontally by the lower transfer device to the lower end position of the first elevator shaft, from which it can be moved again in an upward direction. In this case, in particular a plurality of, for example four, elevator cars per elevator shaft can be moved simultaneously, wherein only one elevator car is coupled to one support means at a time. This allows for particularly effective operation of the elevator system.

The transfer devices can be in particular be designed in accordance with the transfer devices in the form of horizontal displacement units of EP 2219985 B1. In this case, the transfer device has a vertical guide rail piece that guides the elevator car in the transfer device. The transfer device is positionable such that the guide rail piece forms a section of a vertical guide rail, by which the elevator car is guided during a movement in an elevator shaft. The elevator car also has a braking device, by means of which the elevator car can be temporarily fastened to the guide rail piece, which is integrated in the transfer device, during the displacement between the elevator shafts.

In an embodiment of the invention, an equal number of support means with two coupling elements each are arranged in the first elevator shaft and in the second elevator shaft. A number of the elevator cars is at most equal to a total number of the support means of the elevator system. The number of elevator cars is in particular exactly equal to the total number of support means. This means that the number of coupling elements per elevator shaft is greater than or equal to the number of elevator cars to be moved in an elevator shaft. As a result, each elevator car in each of the two elevator shafts can be assigned a specific coupling element or, in the case of simultaneous coupling to two support means, two coupling elements can be assigned, the respective coupling elements being arranged in the two elevator shafts at the same position. In this context, an assignment is supposed to refer to the fact that an elevator car couples via its coupling device exclusively to the coupling element or elements assigned thereto. Each elevator car thus requires only one coupling device or, in case of a simultaneous coupling to two coupling elements, only two coupling devices, which are each arranged in a fixed position. The coupling devices are thus not movable transversely to the actuating direction of the bolts of the coupling devices. This allows for cost-effective implementation of the coupling devices. In addition, the coupling devices also require very little installation space.

For example, in case of two support means (a left and a right support means) and thus four coupling elements (one left and one right coupling element per support means) per elevator shaft, the left coupling element of the left support means can be assigned to the first elevator car, the left coupling element of right support means can be assigned to the second elevator car, the right coupling element of the left support means can be assigned to the third elevator car, and the right coupling element of the right support means can be assigned the fourth elevator car. These assignments are identical in both elevator shafts. The coupling element assigned to an elevator car is thus arranged in the same position in both elevator shafts. For example, the first elevator car thus requires only one coupling device, which is positioned such that it can only be coupled to the left coupling element of the left support means.

Further advantages, features, and details of the invention will become apparent from the following description of embodiments and from the drawings, in which identical or functionally identical elements are provided with identical reference signs. The drawings are merely schematic and not to scale.

DETAILED DESCRIPTION

Figure 1:
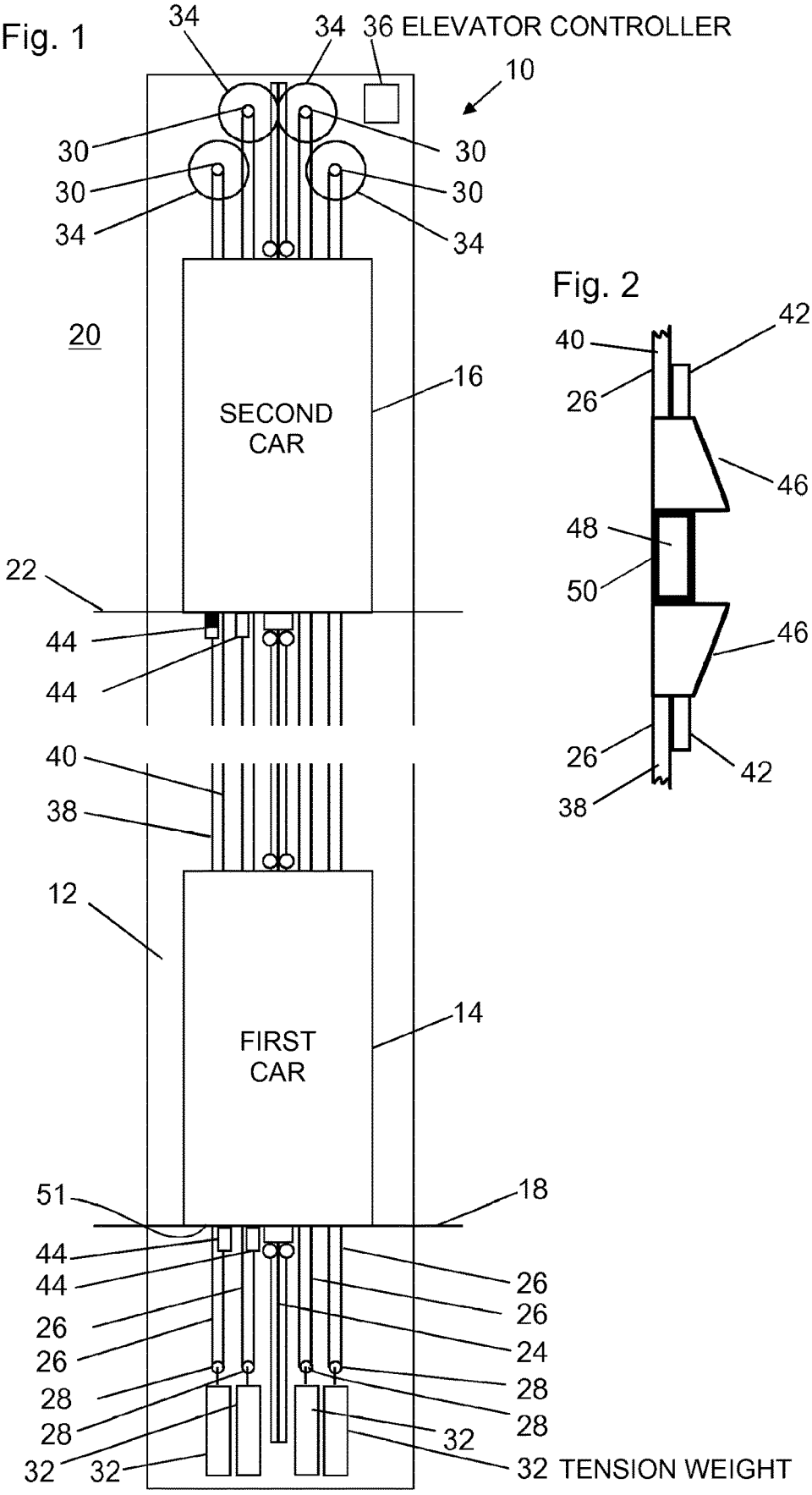
FIG. 1 shows a first elevator shaft of an elevator system having a first and a second elevator car.

According to FIG. 1, an elevator system 10 comprises a first elevator shaft 12, in which a first elevator car 14 and a second elevator car 16 are arranged. The first elevator car 14 is located at a lower end position 18 which corresponds to a position of the elevator car 14 at a lowest floor of the building 20 comprising the elevator system 10. The second elevator car 16 is located at an upper end position 22, which corresponds to a position of the elevator car 16 at a top floor of the building 20. Between the lower end position 18 and the upper end position 22 are a plurality of floors, which are not shown in FIG. 1.

The elevator system 10 has a vertically extending vertical guide rail 24, on which the elevator cars 14, 16 are guided during a movement in the elevator shaft 12. For moving the elevator cars 14, 16 in the elevator shaft 12, the elevator system 10 comprises a total of eight closed support means 26, of which FIG. 1 shows four support means 26. The support means 26 are designed as belts and are each guided about a lower deflection roller 28 and an upper deflection roller 30.

The two deflection rollers 28, 30 of a support means 26 are arranged vertically one above the other, such that the support means 26 extend vertically between the deflection rollers 28, 30. The deflection rollers 28, 30 in particular have an effective diameter of less than 100 mm. The lower deflection rollers 28 are arranged below the first elevator car 14 and are each connected to a tension weight 32. The tension weight 32 acts as a tensioning device, by means of which the required support means pretension is generated, and deviations in the initial length of the closed support means 26 as well as operational plastic changes in length of the support means 26 are compensated.

The upper deflection rollers 30 are arranged above the second elevator car 16 and are each used as a propulsion disk for a drive machine 34 designed as an electric motor. Each support means 26 is assigned a drive machine 34, by means of which the support means 26 can be driven and moved. The drive machines 34 are actuated by an elevator controller 36, which actuates all the actuators of the elevator system 10.

Figure 2:
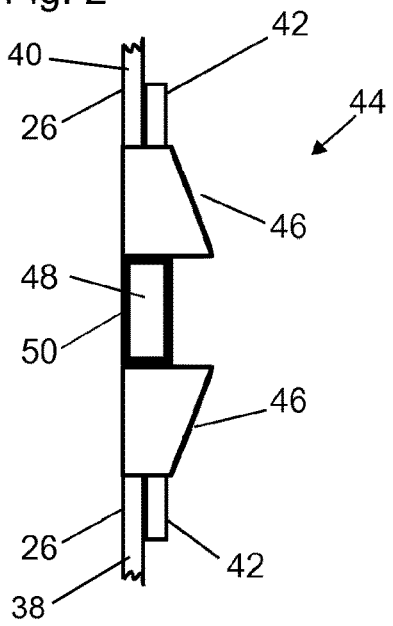
FIG. 2 is an enlarged view of a coupling element of a support means from FIG. 1.

Each support means 26 consists of two support means parts 38, 40, the free ends 42 (see FIG. 2) of which are connected by means of two coupling elements 44, which are shown in an enlarged manner in FIG. 2. In this case, one free end 42 of the first support means part 38 is connected to a free end of the second support means part 40, such that each support means 26 forms a closed ring. A coupling element can thus also be referred to as a connection element. The coupling element 44 consists of two support means end connections 46 which are aligned in the opposite direction and are connected to an intermediate piece 50 comprising a recess 48. The intermediate piece 50 has a mainly cuboid outer contour. The support means end connections 46 can be designed, for example, according to the support means end connections described in EP 1634842 A2. An extendable bolt 60 (see FIG. 4) of a coupling device 58 arranged on an elevator car 14, 16 (see FIG. 4) can be inserted into the recess 48, thus coupling the coupling device 58 to the coupling element 44. By pulling the bolt 60 out of the recess 48, the coupling device 58 can decouple from the coupling element 44. The coupling devices 58 are arranged on a floor 51 of the elevator cars 14, 16 and shall be described in greater detail in connection with FIG. 4. A coupling element 44, to which a coupling device 58 has been coupled, has a filled-in square in the drawings. In FIG. 1, the second elevator car 16 is thus connected via the coupling element 44 to the support means 26 which is arranged on the far left in FIG. 1.

It is also possible for the coupling devices to be arranged on the roof of an elevator car. The positions of the coupling elements on the support means must then be adjusted accordingly.

Once an elevator car 14, 16 is coupled to a coupling element 44 via its assigned coupling device 58, a drive connection is produced between the elevator car 14, 16 and the support means 26. In this coupled state, the elevator car 14, 16 is carried along by the support means 26 and thus moved in the elevator shaft 12 when the support means 26 is driven or moved by the assigned drive machine 34. In the state shown in FIG. 1, the second elevator car 16 can thus be moved in the elevator shaft 12. Since the first elevator car 14 in FIG. 1 is not coupled to a support means 26, a movement of the first elevator car 14 in the elevator shaft 12 is not possible in the state shown in FIG. 1.

Figure 3:
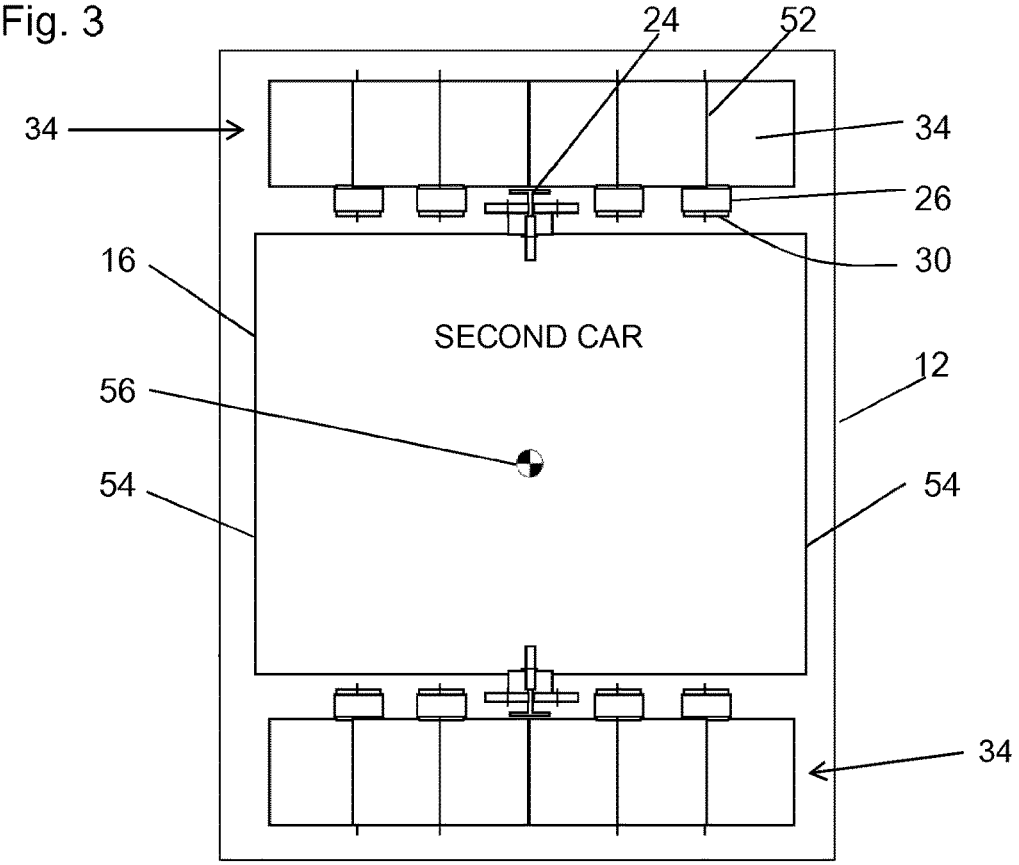
FIG. 3 is a top view of the first elevator shaft having a total of eight drive machines.

FIG. 3 is a top view of the first elevator shaft 12 having a total of eight drive machines 34. The drive machines 34 are each drive-connected to a propulsion disk in the form of a deflection roller 30, over which one support means 26 runs. For reasons of clarity, the reference signs in FIG. 3 are only shown once. Four drive machines 34 are each arranged on opposite sides of the elevator car 16, and, on each of the opposite sides of the elevator car 16, two drive machines 34 are arranged on different sides of the vertical guide rail 24. Drive axles 52 of the drive machines 34 extend in parallel with one another, a relevant drive machine 34 being arranged on one side of the elevator car 16 coaxially with a drive machine 34 on the other side of the elevator car 16. On one or both free sides 54 of the elevator car 16, on which no drive machines 34 are arranged, a car door (not shown) of the elevator car 16 is located.

The elevator controller 36 similarly or synchronously actuates two drive machines 34 on opposite sides, such that their assigned support means 26 also move synchronously or are moved synchronously. Two drive machines 34 are actuated in the same way, which are arranged diagonally with respect to a center of gravity 56 of the elevator car, i.e. for example, in FIG. 3, the upper, far left drive machine 34 and the lower, far right drive machine 34. By means of the eight drive machines 34, a total of four elevator cars 14, 16 can thus be moved simultaneously and independently of one another in the first elevator shaft 12.

Figure 4:
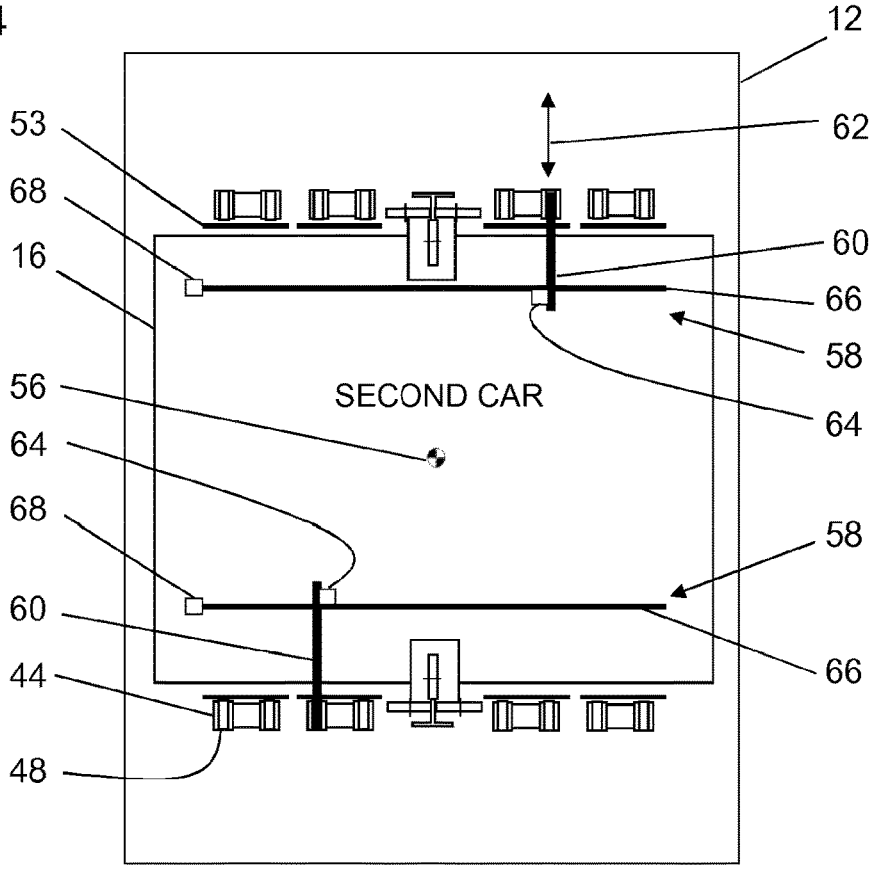
FIG. 4 is a bottom view of an elevator car having two coupling devices for coupling to coupling elements of the support means and FIG. 5*a*-5*c* are highly simplified views of an elevator system comprising two elevator shafts, two transfer devices, and two elevator cars, with different positions of the elevator cars to illustrate the operating principle of the elevator system.

FIG. 4 is a bottom view of the elevator car 16 comprising two coupling devices 58 for coupling to coupling elements 44 of the support means 26. The coupling devices 58 are each arranged opposite the drive machines 34 (not shown in FIG. 4), and thus opposite the coupling elements 44 of the support means 26. Each coupling device 58 has a bolt 60 which can be extended and retracted in an actuating direction 62 which is oriented in the direction of the coupling elements 44. For extending and retracting the bolt 60, the coupling device 58 has an actuator 64, which can be designed, for example, as an electric motor. For positioning the bolt 60 opposite the coupling elements 44, the bolt 60 together with the actuator 64 can be displaced horizontally and perpendicularly to the actuating direction 62 along a rail 66 by means of a positioning actuator 68, which, for example, is also designed as an electric motor.

For coupling a coupling device 58 and thus the elevator car 16 to a coupling element 44 and thus to a support means 26, the bolt 60 is first correctly positioned with respect to the corresponding coupling element 44. Subsequently, the bolt 60 is extended, whereby the bolt 60 is inserted into the recess 48 in the coupling element 44. This produces an interlocking connection between the coupling device 58 and the coupling element 44 and thus between the elevator car 16 and the support means 26. Once this interlocking connection is produced, the elevator car 16 is moved in the elevator shaft 12 as soon as the support means 26 is driven or moved by the drive machine 34.

As already described in connection with FIG. 3, the elevator car 16 is coupled to two support means 26, which are arranged diagonally with respect to the center of gravity 56 of the elevator car. This is achieved in that the elevator car 16 is coupled to coupling elements 44, which are arranged diagonally with respect to the center of gravity 56 of the elevator car 16.

Each coupling element 44 is guided by a guide 53 during the movement in the elevator shaft 12. The guide 53 is arranged between each coupling element 44 and the elevator car 16 and extends through the entire elevator shaft 12. The guides 53 in particular prevent a free coupling element 44, i.e. a coupling element 44 not coupled to an elevator car 14, 16, from striking a passing elevator car 14, 16.

It is also possible for the bolts of the coupling devices not to be movable transversely to the actuating direction. In this case, the coupling devices have separate bolts and actuators for each coupling element.

It is also possible for an elevator car to only comprise one coupling device, such that, for moving in the elevator shaft, an elevator car is coupled to only one support means. This is the case in particular when the drive machines and thus the support means are arranged on a side of the elevator cars which is opposite the car door and thus the shaft doors.

Figure 5A:
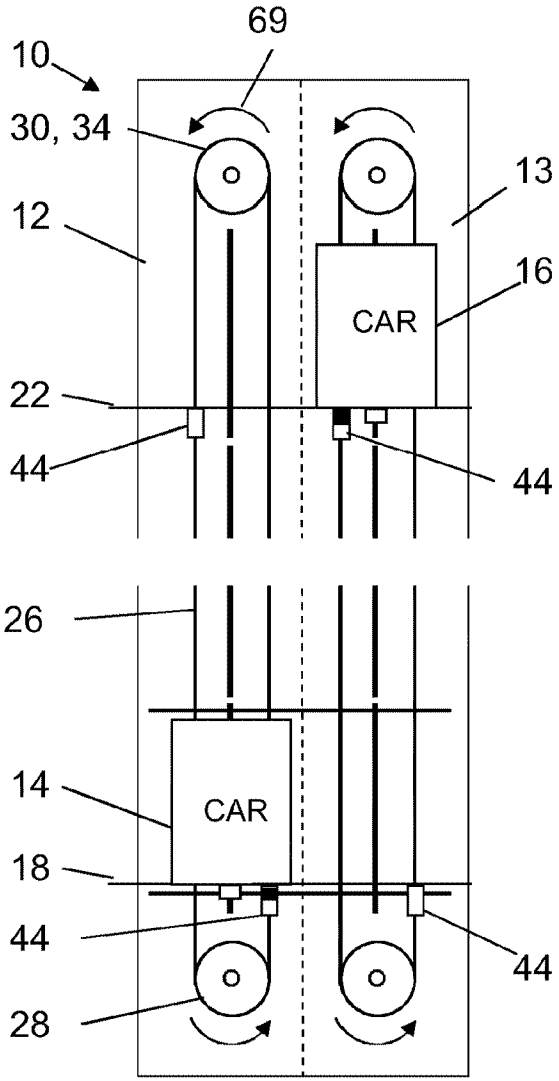
Figure 5B:
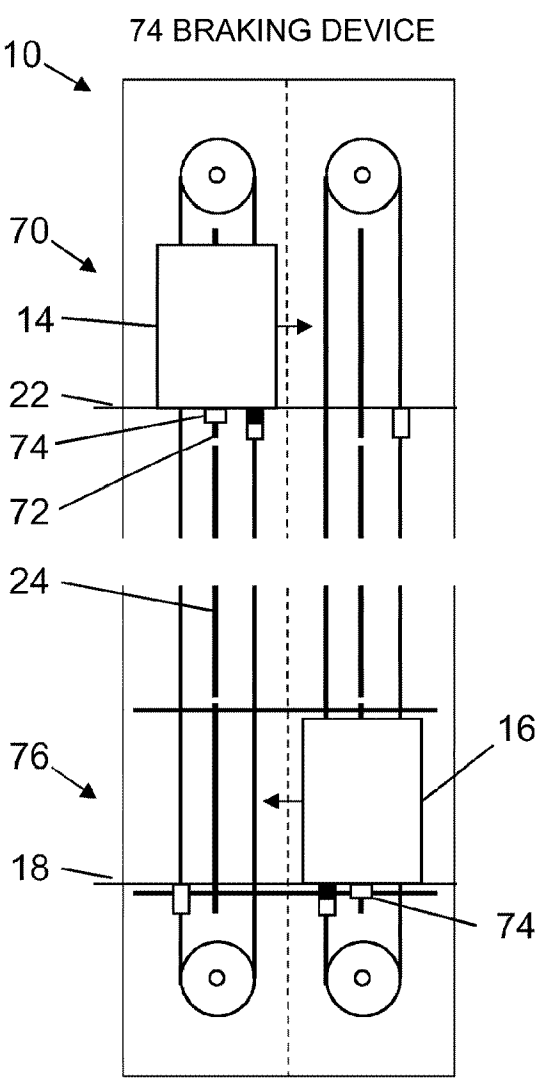
Figure 5C:
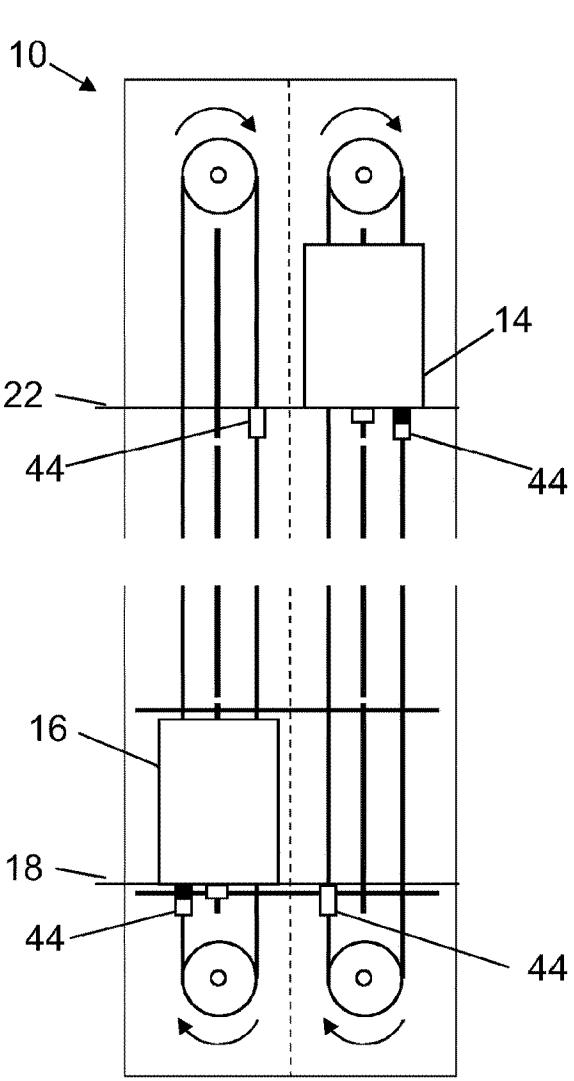

The views in FIGS. 5*a*, 5*b*, and 5*c* describe in greater detail the operating principle of the elevator system 10 and in particular the arrangement of the two coupling elements 44 of a support means 26. For reasons of clarity, only one upper and one lower region of the elevator system 10 and only one support means 26 is shown per elevator shaft in FIGS. 5*a*, 5*b*, and 5*c*. In addition, the deflection rollers 28, 30 are shown with a larger diameter when compared with FIG. 1.

In addition to a first elevator shaft 12, the elevator system 10 according to FIGS. 5*a*, 5*b*, and 5*c* has a second elevator shaft 13 which is arranged in parallel with the first elevator shaft 12. The second elevator shaft 13 is designed analogously to the first elevator shaft 12. The movement of the elevator cars 14, 16 in the second elevator shaft 13 is carried out analogously to the movement in the first elevator shaft 12. In the first elevator shaft 12, the elevator cars 14, 16 are moved only in an upward direction, and in the second elevator shaft 13, they are moved only in a downward direction.

In FIG. 5*a*, the first elevator car 14 is located in the first elevator shaft 12 at the lower end position 18. It is coupled via its coupling device (not shown in FIGS. 5*a*, 5*b*, and 5*c*) to a first coupling element 44 of the second support means 26, said coupling element being on the right in FIG. 5*a*. In this case, the first elevator car 14 has only a single, non-movable coupling device. The coupling device is arranged such that it can be coupled to the right coupling element 44. The first elevator car 14 can thus only be coupled to the right coupling element 44, such that the first elevator car 14 is assigned the right coupling element 44.

A second coupling element 44 (on the left in FIG. 5*a*) of the support means 26 is arranged on the support means 26 such that a coupling device of an elevator car located at the upper end position 22 could decouple from the second coupling element 44. A deflection roller 28, 30 is arranged between the first coupling element 44 and the second coupling element 44 of the support means 26 in each case.

For moving the first elevator car 14 upwards, the drive machine 34 drives the upper deflecting roller 30 in a counter-clockwise movement direction, indicated by a directional arrow 69. With possible intermediate stops on floors between the lower end position 18 and the upper end position 22, the first elevator car 14 is moved to the upper end position 22. Simultaneously with the upward movement of the first coupling element 44 (on the right in FIG. 5*a*), the second coupling element 44 (on the left in FIG. 5*a*) is moved in a downward direction. During said movement, neither of the two coupling elements 44 comes into contact with one of the two deflection rollers 28, 30. The coupling elements 44 thus neither touch either of the two deflection rollers 28, 30 nor are they guided about the deflection rollers 28, 30.

In FIG. 5*a*, the second elevator car 16 is located in the second elevator shaft 13 at the upper end position 22. It is coupled via its coupling device (not shown in FIGS. 5*a*, 5*b*, and 5*c*) to a first coupling element 44 (on the left in FIG. 5*a*) of the support means 26. The second elevator car 16 also has only a single, non-movable coupling device. The coupling device is arranged such that it can be coupled to the left coupling element 44. The second elevator car 16 can thus only be coupled to the left coupling element 44, such that the second elevator car 16 is assigned the left coupling element 44.

A second coupling element 44 (on the right in FIG. 5*a*) of the support means 26 is arranged on the support means 26 such that a coupling device of an elevator car located at the lower end position 18 could decouple from the second coupling element 44. A deflection roller 28, 30 is arranged between the first coupling element 44 and the second coupling element 44 of the support means 26 in each case.

For moving the second elevator car 16 in a downward direction, the drive machine 34 also drives the upper deflection roller 30 in the counter-clockwise direction. With possible intermediate stops on floors between the upper end position 22 and the lower end position 18, the second elevator car 16 is moved to the lower end position 18. Simultaneously with the downward movement of the first coupling element 44 (on the left in FIG. 5*a*), the second coupling element 44 (on the right in FIG. 5*a*) is moved in an upward direction. During said movement, neither of the two coupling elements 44 comes into contact with one of the two deflection rollers 28, 30.

FIG. 5*b* shows the situation in which the first elevator car 14 in the first elevator shaft 12 has reached the upper end position 22 and the second elevator car 16 in the second elevator shaft 13 has reached the lower end position 18. Since the elevator cars 14, 16 in the first elevator shaft 12 are moved only upwards and those in the second elevator shaft 13 are moved only downwards, both elevator cars 14, 16 must execute a shaft change.

For executing shaft changes, the elevator system 10 has a first, upper transfer device 70, by means of which the first elevator car 14 can be displaced at the upper end position 22 from the first elevator shaft 12 to the second elevator shaft 13. The first transfer device 70 has a vertical guide rail piece 72 which guides the first elevator car 14 in the first transfer device 70. Before the start of the displacement, the first transfer device 70 is positioned such that the guide rail piece 72 forms a portion of the vertical guide rail 24 of the first elevator shaft 12, by means of which the first elevator car 14 is guided during a movement in the first elevator shaft 12. The first elevator car 14 has a braking device 74, by means of which the first elevator car 14 is temporarily fastened to the guide rail piece 72, which is integrated in the first transfer device 70, during the displacement between the first elevator shaft 12 and the second elevator shaft 13.

The elevator system 10 also has a second, lower transfer device 76 for displacing the second elevator car 16 in the lower end position 18 from the second elevator shaft 13 to the first elevator shaft 12. The second, lower transfer device 76 is designed analogously to the first, upper transfer device 70. The second elevator car 16 also has a braking device 74.

The transfer devices 70, 76 can be designed in particular in accordance with the transfer devices in the form of horizontal displacement units from EP 2219985 B1.

FIG. 5*c* shows the situation after the displacement of the two elevator cars 14, 16. The first elevator car 14 is positioned in the second elevator shaft 13 at the upper end position 22, and the second elevator car 16 is positioned in the first elevator shaft 12 at the lower end position 18.

The second elevator car 16 currently arranged in the first elevator shaft 12 at the lower end position 18 is now coupled via its coupling device to the second coupling element 44 (on the left in FIG. 5*c*) of the support means 26. The first coupling element 44 (on the right in FIG. 5*c*) of the support means 26 is arranged on the support means 26 such that a coupling device of an elevator car located at the upper end position 22 could decouple from the second coupling element 44.

For moving the second elevator car 16 upwards, the drive machine 34 now drives the upper deflection roller 30 in the clockwise direction. The drive machine 34 is thus actuated by the elevator controller such that the movement direction of the support means 26 is reversed for the next movement of an elevator car when an elevator car has reached the lower end position or the upper end position.

With possible intermediate stops on floors between the lower end position 18 and the upper end position 22, the second elevator car 16 is moved to the upper end position 22. Simultaneously with the upward movement of the second coupling element 44 (on the left in FIG. 5*c*), the first coupling element 44 (on the right in FIG. 5*c*) is moved in a downward direction.

In FIG. 5*c*, the first elevator car 14 is located in the second elevator shaft 13 at the upper end position 22. It is coupled via its coupling device to the second coupling element 44 (on the right in FIG. 5*c*) of the second support means 26. The first coupling element 44 (on the left in FIG. 5*c*) of the support means 26 is arranged on the support means 26 such that a coupling device of an elevator car located at the lower end position 18 could decouple from the second coupling element 44.

For moving the first elevator car 14 in a downward direction, the drive machine 34 now also drives the upper deflection roller 30 in the clockwise direction. In comparison with FIG. 5*a*, the movement direction of the support means 26 is thus also reversed. With possible intermediate stops on floors between the upper end position 22 and the lower end position 18, the first elevator car 14 is moved to the lower end position 18. Simultaneously with the downward movement of the second coupling element 44 (on the right in FIG. 5*c*), the first coupling element 44 (on the left in FIG. 5*c*) is moved in an upward direction.

According to the diagram shown in FIG. 5*a*-5*c*, four elevator cars per elevator shaft and thus a total of eight elevator cars can be moved simultaneously in the vertical direction in the elevator system according to FIG. 1-4.

It is also possible for the elevator system to have a third elevator shaft, in which elevator cars which are currently not needed can be parked.

Lastly, it should be noted that terms such as "comprising", "having", etc. do not preclude other elements or steps and terms such as "a/an" or "one" do not preclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system, comprising:

a first elevator car and a second elevator car each movable in a first elevator shaft in the vertical direction;

a closed support means guided about a lower deflection roller and an upper deflection roller in the first elevator shaft;

a drive machine driving the support means;

an actuatable coupling device arranged on the first elevator car and another actuatable coupling device arranged on the second elevator car;

the support means having a first coupling element and a second coupling element to and from which the coupling devices can be coupled and decoupled, whereby a drive connection can be established and detached between the elevator cars and the support means and the elevator cars can be moved in the first elevator shaft by the support means driven by the drive machine;

wherein the first and second coupling elements of the support means are arranged such that in a movement of the first elevator car coupled to the support means via the associated coupling element, from a lower end position to an upper end position in the elevator shaft, or vice versa, neither of the coupling elements is guided about one of the deflection rollers; and wherein the first and second coupling elements of the support means are arranged such that in a movement of the first elevator car coupled to the support means via the one of the coupling elements, from the lower end position to the upper end position, or vice versa, neither of the coupling elements contacts with either of the deflection rollers.

2. The elevator system according to claim 1 where in the first and second coupling elements of the support means are arranged such that, when the first elevator car coupled to the support means via one of the coupling elements has reached the upper end position, another of the coupling elements is positioned such that the coupling device arranged on the second elevator car located in the lower end position can be coupled to the another coupling element.

3. The elevator system according to claim 1 wherein the drive machine is actuated by an elevator controller to reverse a movement direction of the support means for a next movement of either of the elevator cars that has reached the lower end position or the upper end position.

4. The elevator system according to claim 1 including another closed support means having two coupling elements spaced apart from one another in the vertical direction and another drive machine driving the another support means.

5. The elevator system according to claim 4 wherein the coupling elements of each the support means each interconnect two free ends of two support means parts.

6. The elevator system according to claim 4 wherein the coupling elements of each of the support means are configured as connecting elements.

7. The elevator system according to claim 4 wherein the support means are belts.

8. The elevator system according to claim 1 including a guide guiding the first and second coupling elements in the first elevator shaft.

9. The elevator system according to claim 1 wherein the first and second elevator cars each have two of the coupling means to simultaneously couple to the coupling elements of two of the support means.

10. The elevator system according to claim 9 wherein the two coupling devices are arranged on opposite sides of each of the elevator cars.

11. The elevator system according to claim 10 wherein the two coupling devices on each of the elevator cars are arranged at diagonally opposite positions.

12. An elevator system, comprising:

a first elevator car and a second elevator car each movable in a first elevator shaft in the vertical direction;

a closed support means guided about a lower deflection roller and an upper deflection roller in the first elevator shaft;

a drive machine driving the support means;

an actuatable coupling device arranged on the first elevator car and another actuatable coupling device arranged on the second elevator car;

the support means having a first coupling element and a second coupling element to and from which the coupling devices can be coupled and decoupled, whereby a drive connection can be established and detached between the elevator cars and the support means and the elevator cars can be moved in the first elevator shaft by the support means driven by the drive machine;

wherein the first and second coupling elements of the support means are arranged such that in a movement of the first elevator car coupled to the support means via the associated coupling element, from a lower end position to an upper end position in the elevator shaft, or vice versa, neither of the coupling elements is guided about one of the deflection rollers;

wherein the first elevator car and the second elevator car are movable in the vertical direction in a second elevator shaft arranged in parallel with the first elevator shaft;

a first transfer device for displacing the elevator cars from the first elevator shaft to the second elevator shaft;

a second transfer device for displacing the elevator cars from the second elevator shaft to the first elevator shaft; and wherein a movement of the elevator cars in the second elevator shaft is realized analogously to the movement in the first elevator shaft.

13. The elevator system according to claim 12 wherein the elevator cars are moved only from a bottom to a top in the first elevator shaft, and are moved only from a top to a bottom in the second elevator shaft.

14. The elevator system according to claim 12 wherein an equal number of the support means, each having two coupling elements, are arranged in each of the first elevator shaft and the second elevator shaft, and a number of the elevator cars movable in the first and second elevator shafts is at most equal to a total number of the support means.

15. An elevator system, comprising:

a first elevator car and a second elevator car each movable in a first elevator shaft in the vertical direction;

a closed support means guided about a lower deflection roller and an upper deflection roller in the first elevator shaft, the support means extending along and spaced from a side of each of the first and second elevator cars;

a drive machine driving the support means;

an actuatable coupling device arranged on the first elevator car and another actuatable coupling device arranged on the second elevator car;

the support means having a first coupling element and a second coupling element to and from which the coupling devices can be coupled and decoupled, whereby a drive connection can be established and detached between the elevator cars and the support means and the elevator cars can be moved in the first elevator shaft by the support means driven by the drive machine;

wherein the first and second coupling elements of the support means are arranged such that in a movement of the first elevator car coupled to the support means via the associated coupling element, from a lower end position to an upper end position in the elevator shaft, or vice versa, neither of the coupling elements is guided about one of the deflection rollers; and wherein the first and second coupling elements of the support means are arranged such that in a movement of the first elevator car coupled to the support means via the one of the coupling elements, from the lower end position to the upper end position, or vice versa, neither of the coupling elements contacts with either of the deflection rollers.

* * * * *